US005836459A

United States Patent [19]

Nezwek et al.

[11] Patent Number: 5,836,459

[45] Date of Patent: Nov. 17, 1998

[54] COMPACT, HIGH VISIBILITY DISPLAY RACK AND CONFIGURATION

[75] Inventors: Joseph F. Nezwek, Redondo Beach; James R. Plumb, Altadena, both of Calif.

[73] Assignee: Avery Dennison Corporation, Pasadena, Calif.

[21] Appl. No.: 641,878

[22] Filed: May 2, 1996

[51] Int. Cl.[6] ..... A47F 5/00

[52] U.S. Cl. ..... 211/50; 211/106; 211/88.01

[58] Field of Search ..... 211/50, 55, 88, 211/106, 48; 248/220.31, 220.41, 220.42, 220.43

[56] References Cited

U.S. PATENT DOCUMENTS

| | | | |
|---|---|---|---|
| 2,868,391 | 1/1959 | Sides | 211/181 |
| 3,115,252 | 12/1963 | Senical | 248/220.42 X |
| 3,229,823 | 1/1966 | Hummer | 211/181 X |
| 3,501,015 | 3/1970 | Behles | 248/220.41 X |
| 3,647,076 | 3/1972 | Heimann | 211/88 |
| 3,661,269 | 5/1972 | Scherzer | 211/49 |
| 3,918,588 | 11/1975 | Walser et al. | 211/181 X |
| 3,921,813 | 11/1975 | Cimino | 211/181 X |
| 4,248,352 | 2/1981 | White | 211/88 |
| 4,343,405 | 8/1982 | Virte et al. | 211/88 |
| 4,415,091 | 11/1983 | Wolff | 211/50 |
| 4,632,256 | 12/1986 | Gambello | 211/50 |
| 4,684,030 | 8/1987 | Gurzynski | 211/88 |
| 4,694,966 | 9/1987 | Sorenson et al. | 211/88 |
| 4,813,535 | 3/1989 | Radocha et al. | 211/106 X |
| 4,898,354 | 2/1990 | Whittington et al. | 248/225 |
| 5,292,010 | 3/1994 | Pickles et al. | 211/41 |
| 5,335,797 | 8/1994 | Myers | 248/220.31 X |
| 5,390,443 | 2/1995 | Emalfarb et al. | 211/88 X |
| 5,397,087 | 3/1995 | Teece | 211/106 X |
| 5,449,076 | 9/1995 | Van Noord | 211/106 X |

*Primary Examiner*—Robert W. Gibson, Jr.
*Attorney, Agent, or Firm*—Oppenheimer Poms Smith

[57] ABSTRACT

A compact, high-visibility display rack and assembly system is disclosed. The innovative display rack includes a base, a pair of sides, and a mounting bracket which is connected to the base and the sides at an angle relative to the horizontal elongated plane of the base. Because the mounting bracket is at an angle relative to the base and the rest of the display rack, when the rack is mounted on a supporting surface, the display rack extends outward from the supporting surface at an acute angle, providing an angular view of the front of product packages contained therein. In addition, the top, most of the front, and a portion of a side of the display rack is open, allowing for easy access of the product packages contained therein. Furthermore, the sides of the display rack are built using wire-frame construction or transparent plastic to further enhance the visibility and the ease of access of the contents therein. All these factors—angled mounting, open design, and high visibility design—combine to create an innovative display rack and assembly system which provide easy consumer viewing and accessibility for the contents therein while providing compact mounting to maximize the use of the supporting surface area.

17 Claims, 5 Drawing Sheets

FIG. 4
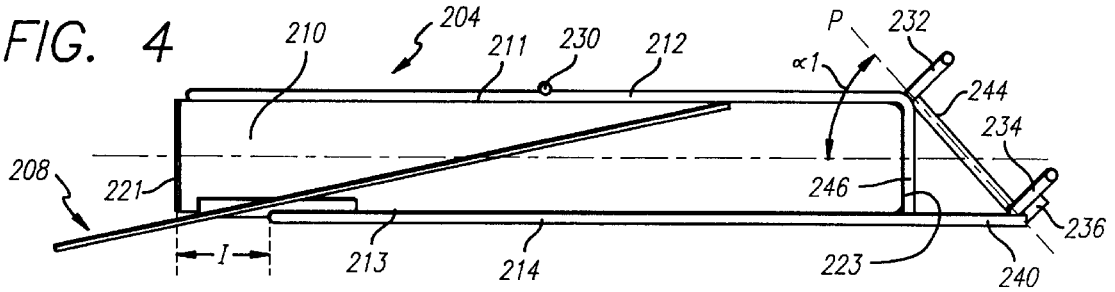
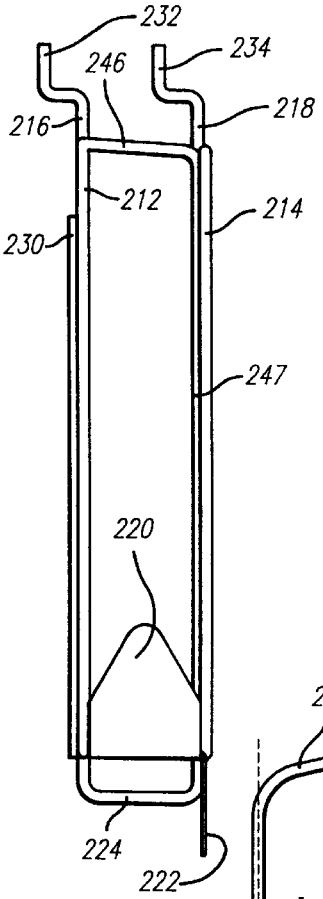
FIG. 6
FIG. 5
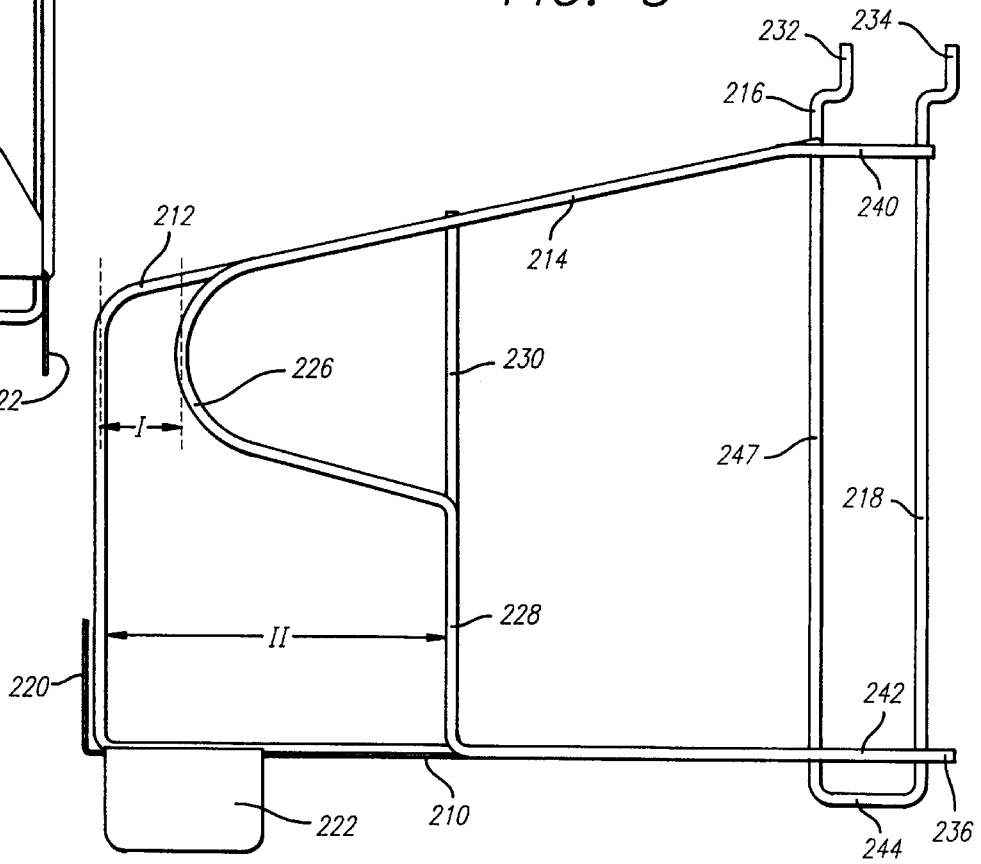

COMPACT, HIGH VISIBILITY DISPLAY RACK AND CONFIGURATION

BACKGROUND OF THE INVENTION

1. Field of the Invention

The present invention generally relates to display rack systems mountable on supporting surfaces, and in particular, to display rack systems suitable for displaying relatively thin sheet type product packages.

2. Description of Related Art

Although there are many designs for display racks mountable on supporting surfaces such as pegboards to display flat product packages, the designs can be categorized into two major categories. The first category of display rack designs aims for high-visibility of the product packages being displayed at the cost of limiting the number of different product packages which can be displayed within a given area of the supporting surface on which the racks are mounted. The second category of display rack designs aims to display a greater number of different product packages at the cost of limiting the visibility of the product packages to potential purchasers.

Display racks belonging to the first design category, the "high-visibility" display rack designs, generally store the products being displayed with the front of the product packages facing outward from the supporting surface, toward potential purchasers. The advantage of this category of display rack designs is that the front of the product packages which may include eye-catching designs, is in full view of potential purchasers. In addition, the product packages contained in the display racks are easily accessible by potential purchasers. The disadvantage of this category of display rack designs is that the display racks generally require much display space, limiting its usefulness if the supporting surface area is limited.

For example, if there are fifteen product packages, each containing a different product, and the frontal area of each of the product packages is one square foot, then not all of the different product packages can be displayed with the front of the packages facing outward on supporting surface area of ten square feet.

Display racks belonging to the second design category, the "high-capacity" display rack designs, generally store the products being displayed with the edges of the product packages facing outward from the supporting surface, toward potential purchasers. The advantage of this approach is that a greater number of different product packages can be displayed upon a given supporting surface area. The disadvantage of this approach is that because the product packages must be displayed with its edges facing out from the supporting surface, the visibility of the product packages to potential purchasers are limited. In addition, the display racks must be mounted with sufficient space in between the racks to allow access to the product packages contained therein for potential purchasers to remove the packages from the rack.

The visibility of the front of the product packages and the accessibility to the packages can be increased even while utilizing the high-capacity type display racks by increasing the space between the mounted display racks on the supporting surface. However, this mounting technique reduces the number of display racks mountable on a given area of supporting surface thereby reducing the number of different product packages which can be displayed. FIG. 1 accompanying this application illustrates the use of high-capacity type display racks mounted on a supporting surface with sufficient spaces in between the rows of the display racks to increase the visibility of and the accessibility to the product packages contained therein. FIG. 1 will be further discussed below.

Typical display racks of the high-capacity design category are shown by the U.S. Pat. No. 4,898,354 entitled PEG BOARD DISPLAY BRACKETS issued to Paul S. Whittington and James Morison and U.S. Pat. No. 4,632,256 entitled ADJUSTABLE ARTICLE DISPLAY APPARATUS issued to Vincent J. Gambello (collectively, "the references"). The references show high-capacity type display brackets designed to be mounted perpendicularly on a pegboard. As discussed above, these references disclose display rack designs which can be mounted compactly if visibility of and access to the product packages contained therein are sacrificed due to their closed design including solid front and side members and perpendicular mounting of the racks to the supporting surface.

The U.S. Pat. No. 4,684,030 entitled DISPLAY RACK ASSEMBLY issued to Gurzynski (the "Gurzynski reference") discloses an interesting modification to the high-capacity type display rack design by describing an assembly of interlocking vertical panels resulting in angled display surfaces upon which shelf brackets are attached. However, the invention disclosed by the Gurzynski reference does not disclose individual display rack design; rather, the reference discloses a "assembly of interlocking vertical panels" (emphasis added) with built-in shelf brackets, heights of which may be adjusted similar to adjustable book shelves.

SUMMARY OF THE INVENTION

The display rack assembly of the present invention is a high visibility display rack assembly for compactly displaying flat products for sale. The display rack assembly includes a supporting surface and a plurality of racks mounted relatively closely together on the supporting surface. The display racks extend outward from the supporting surface at an acute angle of between about thirty degrees and sixty degrees from the supporting surface. Each of the racks mounted on the supporting surface define a storage space for storing and displaying a plurality of relatively thin sheet type product packages having a size substantially equal to or greater than three inches by five inches. The width of the storage space is not limited except by the number and the thickness of the product packages to be displayed; however, typically, the width is greater than ½ inches but not greater than six inches. The racks include restraints for retaining the product packages but also include a front opening to permit easy removal of product packages by prospective purchasers and a configuration which permits clear product visibility. The racks may be mounted on the supporting surface spaced apart from one-another by a distance of from about one half to about twice the width of said storage space.

According to a broad aspect of the present invention, the display racks comprise a narrow base having a first edge, a second edge, a front, and a rear, and defining a storage space, less than three inches wide, for storing a plurality of relatively thin sheet type product packages. There are no limits to the sizes of the packages which may be contained and displayed by the rack of the present invention. For example, packages containing label products may range from three by five inches or substantially greater than 8 ½ by eleven inches. Even larger products such as sketch pads and artists supplies may be displayed using the display rack of the present invention. The display rack further includes securing arrangements for mounting the display rack to a supporting surface at an angle of between thirty and sixty degrees.

To increase the visibility of the front of the product packages being displayed, the side members of the display racks may comprise open-frame construction using such materials as coated wire or cylindrical tubes. In fact, wire-frame construction using sufficiently thick wire may be particularly suitable for the present invention because the end portions of the wire-frame may be angled for mounting purposes on a pegboard. In addition, open-frame construction results in such economical advantages as minimal material requirements and lighter weight.

The display rack of the present invention may embody additional features such as unequally sized side members to increase visibility and access, unified bracket assembly for strength, and a label tab to display price or other relevant information pertaining to the contents therein.

It is also noted in passing that racks of the type disclosed herein could be employed for displaying smaller stationery products, such as three by six inch label packages which are about ¼ inch to ⅜ inch thick.

Other aspects, features and advantages of the present invention will be apparent to one skilled in the art upon reading the following detailed description and examining the accompanying drawings.

BRIEF DESCRIPTION OF THE DRAWINGS

FIG. 4 is a top view of a preferred embodiment of a compact, high visibility display rack Illustrating the present invention;

FIG. 5 is a side view of a preferred embodiment of the compact, high visibility display rack of Fig. 4;

FIG. 6 is a front view of a preferred embodiment of the compact, high visibility display rack of FIG. 4;

DETAILED DESCRIPTION OF THE PREFERRED EMBODIMENT(S)

Figure 1:
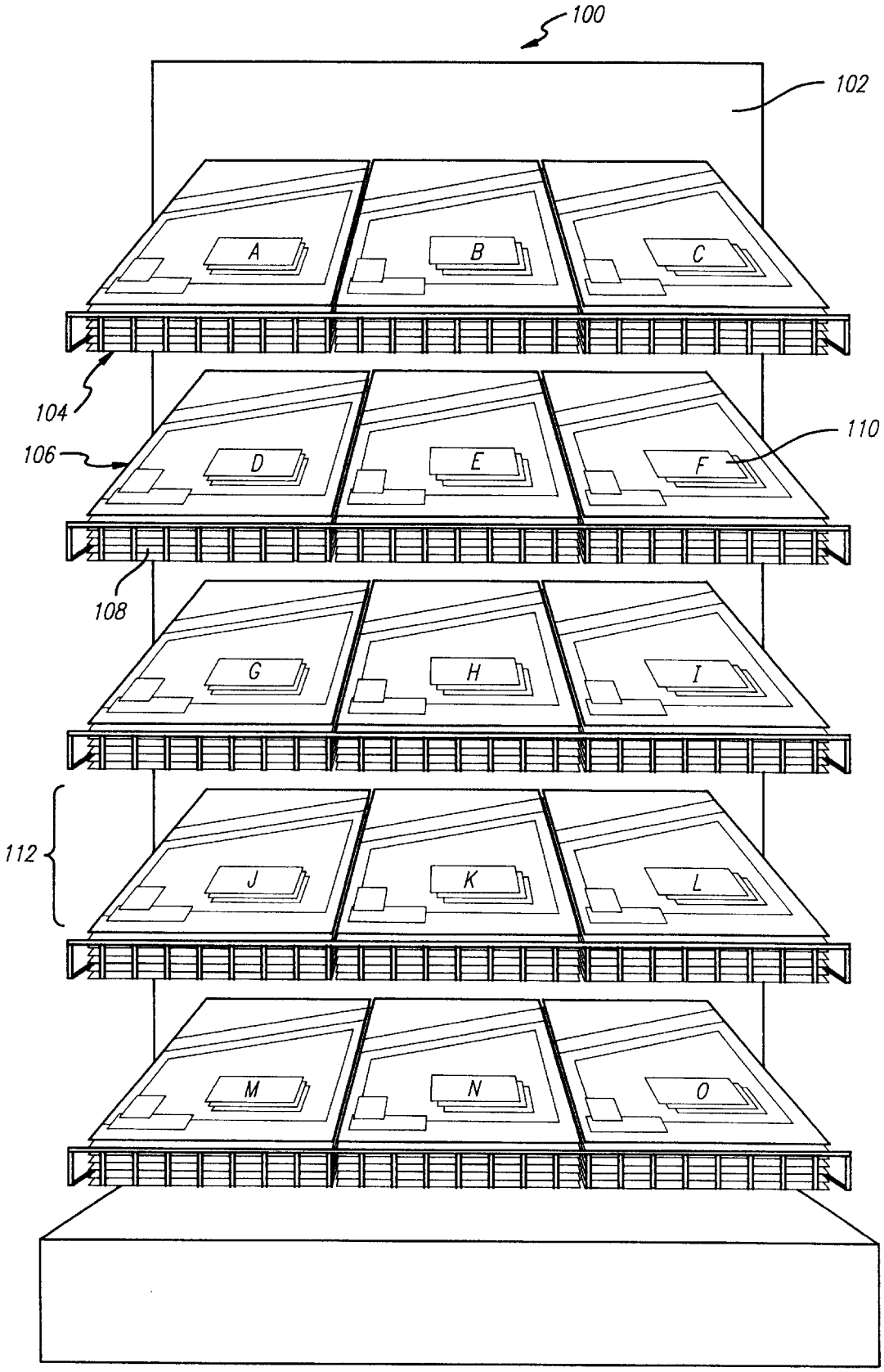
FIG. 1 PRIOR ART
FIG. 1 a front view of a prior art display rack system.

Referring more particularly to the drawings, FIG. 1 is a front view of a prior art display rack system. The figure depicts a display rack system 100 comprising supporting surface 102 with a plurality of display racks 104. In the figure, five rows of three display racks each are mounted on the supporting surface 102. Also, each of the fifteen display racks is holding one of fifteen different product packages labeled A through O.

Generally, the edges 108 of the product packages 106 being displayed by the display rack 104 are visible to potential purchasers. In this particular example, the horizontal display racks are mounted with sufficient spaces 112 in between the rows of the racks to increase the visibility of the front 110 of the product packages 106 displayed therein and to allow potential purchases access to the product packages.

Although this mounting technique is a workable compromise between the two rack design categories discussed above, the visibility and access requirements for the packages being displayed impose limitations as to how compactly the display racks can be mounted. For instance, in order to display other product packages within the same supporting surface, the rows of the display racks 104 have to be mounted more compactly by reducing the space 112 between the rows of the racks. However, if the space 112 is reduced to zero (0), then none of the product packages, except for the packages on the very top row, would be accessible to potential purchasers. In addition, because the display racks 104 have been mounted perpendicular to the supporting surface 102, potential purchasers, viewing the display rack system 100, would require a substantial space 112 in between the rows of the racks 104 to view and access the product packages contained therein.

The innovative designs of the display rack system of the present invention reduces the amount of space required in between the mounted display racks while allowing for easy access to the product packages and improved visibility of the front of the product packages contained therein.

Figure 2:
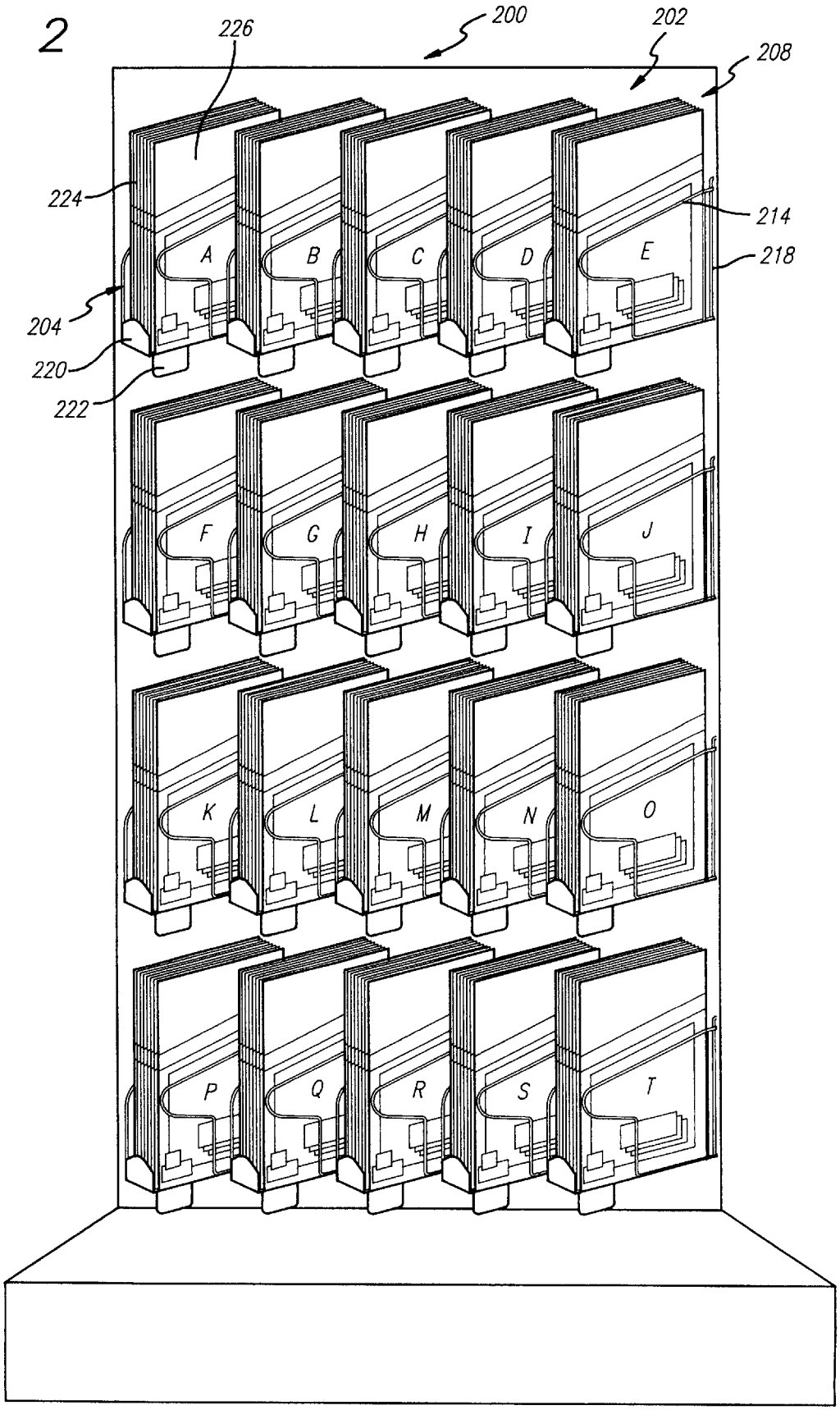
FIG. 2 is a front view of a supporting surface including a plurality of display racks designed and mounted in accordance with the present invention.

Referring to FIG. 2, a rack assembly 200 with a supporting surface 202 is shown with a plurality of display racks 204 attached on the supporting surface 202. The rack assembly 200 is shown with 20 identical display racks 204 mounted relatively close together in four rows of five racks each. The display racks 204 extend outward from the supporting surface 202 at an acute angle to present a portion of the front of the packages contained therein for easy viewing by potential purchases.

Figure 3:
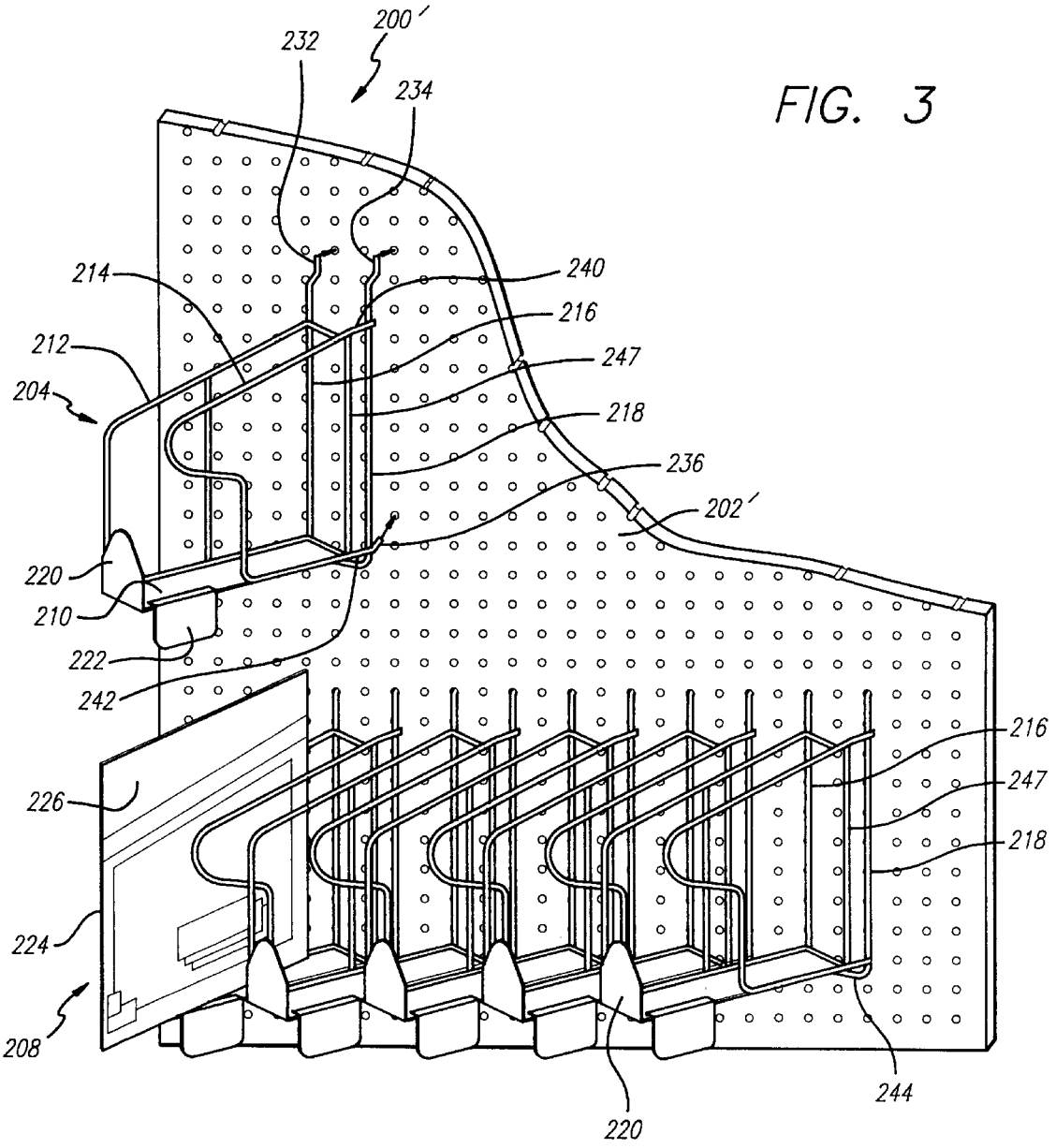
FIG. 3 is a perspective view of a preferred embodiment showing a plurality of compact, high visibility display racks forming a configuration of the present invention with a pegboards the supporting surface.

FIG. 3 provides a more detailed view of the display rack assembly 200'. The rack assembly 200' is a section of a larger supporting surface comprising a pegboard 202' with a plurality of display racks 204 of the present invention.

Referring to FIGS. 2 and 3, the display racks 204 may be compactly mounted on the supporting surface 202. In the preferred embodiment as illustrated by FIG. 2, the display racks 204 are mounted on the supporting surface 202 spaced apart from one another at a distance of about twice the width of said display rack. In FIG. 3, display racks 204 are mounted on the peg board 202' separated by the width of the display rack. In practical applications, the display racks can be spaced apart from one-another by a distance of from about one half to about twice the width of the display rack 204 to achieve the best results.

Continuing to refer to FIGS. 2 and 3, each display rack 204 defines a storage space for storing a plurality of relatively thin sheet type product packages 208. As the following paragraphs will discuss, the storage space defined by the display rack of the present invention comprises a bottom, sides, a front, and a rear with an open top. The open top construction of the display racks 204 allows flexibility in the height of product packages which can be displayed within the rack as well as permitting greater visibility and easier access of the product packages contained therein. To describe the storage space defined by a preferred embodiment of the display rack of the present invention in detail, FIGS. 4, 5, and 6 are illustrative. FIGS. 4, 5, and 6 illustrates a top view, a side view, and a front view of an embodiment of the present invention, respectively, and will be used to describe a preferred embodiment of the present invention in detail.

Referring to FIG. 4, a top view of a preferred embodiment of the present invention is shown. The base 210 forms the bottom of the storage space defined by the display rack and comprises a first side edge 211, a second side edge 213, a front 221, and a rear 223. In the preferred embodiment, the base 210 is approximately one to three inches wide and approximately nine to eleven inches long as to accommodate thin sheet type product packages having a size substantially equal to or greater than 8½ inches by 11 inches. However, the sizes of the various portions of the display rack of the present invention may be modified to accommodate product packages of various sizes.

A first side member 212 spans the length of the first edge 211 to define the right side of the storage space defined by the display rack. In the preferred embodiment as shown more clearly by FIG. 5, the first side member 212 comprises an open wire-frame construction with a support member 230.

Continuing to refer to FIG. 4, but also referring to FIG. 5, a second side member 214 is attached to the second edge 213 of the base 210 to define the left side of the storage space defined by the display rack. Unlike the first side member 212, the second side member 214 does not span the length of the second edge 213 of the base 210. Rather, an upper portion 226 of the second side member 214 extends from the rear 223 toward the front 221 but comes up short near the front 221, leaving an opening I on the second edge 213 between the front 221 and the upper portion 226 of the second side 214. A lower portion 228 of the second side 214 also extends from the rear 223 toward the front 221; however, the lower portion 228 of the second side 214 is even further from the front 221, leaving a larger opening II on the second edge 213 between the front 221 and the lower portion 228 of the second side 214. The opening formed by the second side member permits easy removal of individual product packages by prospective purchasers as illustrated by a partially removed product package 208 of FIGS. 3 and 4.

Although the first side member 212 and the second side member 214 have been discussed as forming the right and the left sides, respectively, of the storage space defined by the display rack 204 which is an exemplary embodiment of the present invention, the present invention may be embodied in other designs requiring the first side member to be the left side and the second side member to be the right side. Other alternative embodiments may be apparent to the one skilled in the art. In addition, one or both of the first and the second side members may be designed to slope down from the rear toward the front to increase the visibility of and the access to the product packages therein.

In the preferred embodiment as shown by FIGS. 2, 3, 4, 5, and 6, the first side member 212, the second side member 214, and other elements of the display rack 204 comprises a wire-frame construction to maximize visibility and access of the contents therein and to minimize the weight of the display rack itself. However, other materials and construction techniques may be used to form the elements of the display rack of the present invention such as transparent plastics.

Referring mostly to FIGS. 4 and 5 but also to FIGS. 6 and 3, a first mounting post 216 is attached to the rear 223 of the base 210 and to the first side member 212. The upper portion 232 of the first mounting post 216 can be angled for fitting into pegboards as illustrated by the figures, or may be shaped to receive hooks, nails, or screws to be mounted on other type of supporting surfaces. The first mounting post 216 discussed here and elements 218 and 247 which will be discussed below, is most easily identifiable using the perspective drawing of FIG. 3.

As best illustrated by FIG. 3, but also shown in FIGS. 4, 5, and 6, a first supporting member 247 is attached to toe rear 223 of the base 210. The first supporting member 247 can be an integral part of the second side member 214.

Also best illustrated by FIG. 3, but also shown in FIGS. 4, 5, and 6, a second mounting post 218 is attached to the rear 223 of the base 210 via a first connecting member 240 and a second connecting member 242. The first and second connecting members 240 and 242 can be extensions of the second side member 214. In addition, the second connecting member 242 can extend beyond the second mounting post 218 to form an angled hook 236 for fitting into pegboards. A third connecting member 244 may be used to attach the second mounting post 218 to the first mounting post 216. In the preferred embodiment, the third connecting member 244 connects to the first mounting post 216 and to the second mounting post 218 as to form a rear U-shaped mounting bracket. Similar to the first mounting post 216, the upper portion 234 of the second mounting post 218 can be angled for fitting into pegboards as best illustrated by FIG. 3, or may be shaped to receive hooks, nails, or screws to be mounted on other type of supporting surfaces.

One of the key elements of the present invention is the location of the first mounting post 216 and the second mounting post 218 relative to the rear 223 of the base 210, enabling the display rack to be mounted, on a supporting surface, at an acute angle. As best illustrated by FIG. 4, the U-shaped mounting bracket formed by the first mounting post 216, the second mounting post 218, and the third connecting member 244, define the plane P. When this U-shaped bracket is mounted on a supporting surface 202 of FIG. 2, the display rack 204 will extend outward from the supporting surface 202 at an acute angle $\alpha 1$ of FIG. 4 relative to the plane P. The angle $\alpha 1$ allows the front 226 of FIG. 2 of the product packages 208 of FIG. 2 to be visible and accessible to the potential purchasers while permitting the display racks 204 to be mounted compactly as shown by FIG. 2.

The angle $\alpha 1$ can be varied by varying the lengths of the first connecting member 240 and the second connecting member 242. Longer connecting members would cause the angle al to decrease, thereby increasing the visibility of the front of the product packages 204 of FIG. 2 contained therein. Shorter connecting members would cause the angle al to increase, thereby allowing the display racks to be mounted more compactly. In the preferred embodiment as shown in FIG. 2, the display racks 204 extend outward from the supporting surface 202 at an angle of between about thirty degrees and sixty degrees from the supporting surface 202.

Referring now to FIGS. 3, 5, and 6, an upright restraining member 220 attached to the front 221 defines the front of the storage space as defined by the display rack of the present invention. The upright restraining member 220 prevents product packages contained in the display rack 204 from slipping out. The upright restraining member 220 is relatively short, leaving most of the front open to allow visibility of the edges 224 of FIG. 2 of the product packages 208 of FIG. 2 and to allow easy access to the product packages by potential purchasers. The open-front design of the display rack 204, combined with the open spaces I and II created by the second side member 214 allows for easy removal access of the contents of the display racks even when the racks are compactly mounted on the supporting surface 202.

Best illustrated by FIG. 5, but also shown in FIGS. 2, 3, and 6, a label tab 222 is attached to the second edge 213 of FIG. 4, proximal to the upright restraining member 220 and the front 221 of FIG. 4 of the base 210. The label tab 222 may be used to display various relevant product information such as the price, size, or quantity. In addition, it may be used to display bar-codes to facilitate inventory control.

Figure 7:
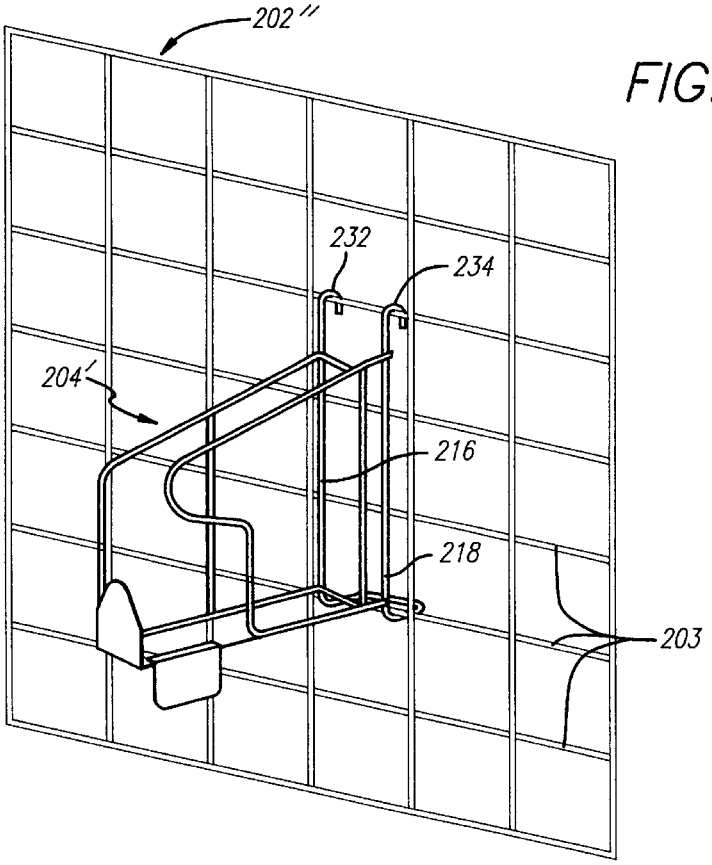
FIG. 7 is a perspective view showing an alternative embodiment of the compact, high visibility display rack mounted on a wire frame support structure as the supporting surface.
Figure 9:
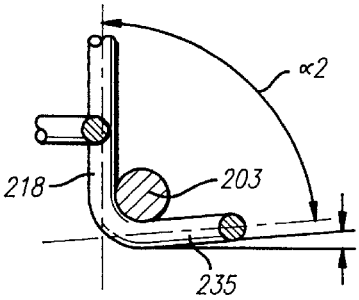
FIG. 9 is a cross sectional view of a lower, rear portion of the alternative embodiment of the compact, high visibility display rack mounted on a wire frame support structure as the supporting surface.
Figure 8:
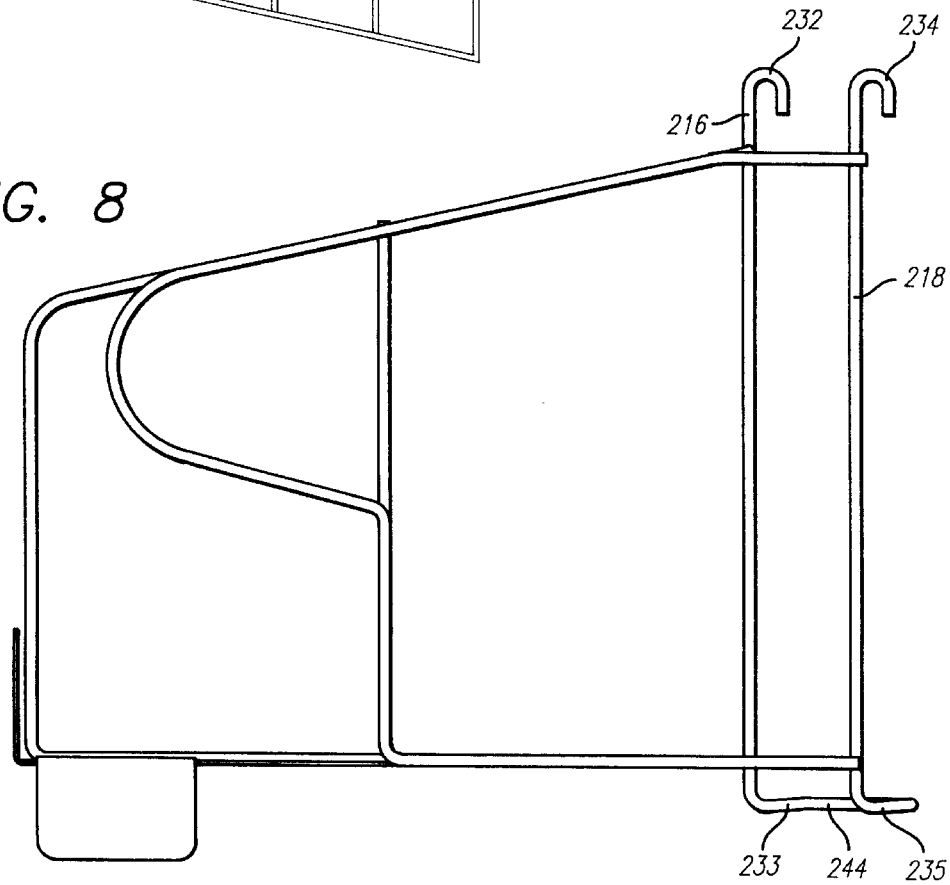
FIG. 8 is a side view of the alternative embodiment of the compact, high visibility display rack.

Referring to FIGS. 7, 8, and 9, illustrating an alternative embodiment of the present invention, the rack 204' is mounted on a supporting surface 202", a wire-frame structure. In order to attach the rack 204' to the wire-frame supporting surface 202", the upper portions of the first and second mounting posts 216, 218, respectively, are shaped to form downward pointing hooks 232 and 234 respectively.

In addition, to increase the stability of the attachment of the rack 204" to the wire-frame supporting surface 202", two additional factors are considered when manufacturing the rack 204'. First, the lower portions 233, 235 of the first and second mounting posts 216, 218, respectively, are connected via a connecting member 244, and formed to an L-shaped angle to be snapped onto an element 203 of the wire-frame supporting surface 202". As most clearly illustrated by FIG. 9, the lower portions of first and second mounting posts 216, 218 are formed to an L-shape at an angle $\alpha 2$, slightly less than ninety degrees. If the angle $\alpha 2$ is equal to or greater than ninety degrees, then the lower portion of the posts will not make positive engagement with the wire-frame element 203. If the angle $\alpha 2$ is much less than ninety degrees, then the flexibility of the rack 204' or the wire-frame supporting surface 204" will not be sufficient to allow the snap-on action. Another factor relating to the mounting of the rack is the length of the mounting posts 216, 218 relative to the distances between the wire-frame elements 203 of the wire-frame supporting surface 204" . The length of the mounting posts is determined such that when the hooks 232, 234 are engaged, the wire elements 233, 235 at the lower portion of the mounting posts are sufficiently proximate to another wire-frame element 203 to effectuate the snap-on coupling.

In the preferred embodiment of the present invention as illustrated by FIGS. 1–9, the compact, high visibility display rack is implemented with the following specifics: (1) the base comprises coated sheet-metal with a length of 9 ¾ inches and the width of 1 ½ inches; (2) the side members and the mounting posts are of wire-frame construction utilizing plastic or rubber coated wire of approximately 3/16 inches in diameter; (3) the mounting post are connected to the base such that when the rack is mounted on a supporting surface, the rack extends forward at an acute angle, $\alpha 1$ of FIG. 4, of between 40 and 50 degrees. In addition, the preferred embodiment of the present invention as illustrated by the figures is implemented with mountings posts which are approximately nine inches high, and the side members slope down from the rear toward the front at approximately 15 degrees. The front restraining member is approximately two inches high and, in the preferred embodiment as shown, is shaped as a pentagon with a pointed top to accommodate the manufacturer's mark and name. The label tab as illustrated by the figures is a rectangle of approximately 1 ½ inches by two inches.

Although the present invention has been described in detail with regarding the exemplary embodiments and drawings thereof, it should be apparent to those skilled in the art that various adaptations and modifications of the present invention may be accomplished without departing from the spirit and the scope of the invention. Thus, by way of example and not of limitation, the racks may be formed of other materials, as noted above, and may be secured to a solid supporting surface at the preferred angles of from about thirty to sixty degrees by screws or other fasteners, and the storage space may be bounded differently from the disclosed wire retaining configuration, as long as high visibility and easy access to the product packages are maintained. Also, racks of the type shown in FIGS. 7 and 8 could be mounted on a partition such as a glass or plastic plate; and for such purposes, the wire 233 and 235 could be omitted. Accordingly, the invention is not limited to the precise embodiment shown in the drawings and described in detail hereinabove.

We claim:

1. A high visibility storage rack assembly, comprising:

an open wire storage construction for receiving and storing at least one thin sheet type product package having a front face side, an obverse face side, a front edge side, and a rear edge side, for receiving thereon eye-catching designs for attracting attention to the product package;

said open wire storage construction including an open front edge side for helping to minimize the weight of the storage rack assembly and for providing user access to the thin sheet type product package to facilitate its removal;

said open wire storage construction further including a base structure for supporting from below the thin sheet type product package, a first side member connected to said base structure and extending substantially perpendicularly therefrom for helping to support the thin sheet type product package from its obverse face side, a second side member extending in a substantially parallel plane to said first side member for helping to support the thin sheet type product package from its front face side without substantially obstructing the eye catching design thereon, and a rear edge side member connected between said first and second side members for helping to support the thin sheet product package from its rear edge side;

a support surface mounting arrangement connected to said open wire storage construction for supporting it removably from a supporting surface so that said first side member, said second side member and said rear edge side member are all disposed at substantially acute angles relative to said supporting surface;

said support surface mounting arrangement including a pair of spaced apart vertical support members each connected to said open wire storage construction for helping to support it removably from said supporting surface; and at least one restraining member connected to said open wire storage construction for helping to prevent the thin sheet type product package from slipping out of a storage area defined by a space bounded by the rear edge side member, the first side member and the second side member of the open wire storage construction.

2. A display rack comprising:

an elongated base having a first edge and a second edge and a front and a rear;

said rack having a storage space for storing a plurality of relatively thin sheet type product packages having a size substantially equal to or greater than three inches by five inches; and U-shaped bracket for mounting said rack to a supporting surface at an angle of between 30 and 60 degrees;

wherein a first side member is attached to said first edge and a second side member is attached to said second edge to hold said product packages within said storage space;

wherein one size side member is on one edge and another-size side member is on the other edge for convenience in removing said product packages contained therein; and wherein said another-size side member comprises an upper portion which is longer than a lower portion for retaining said product packages within said storage space while allowing easy access to said product packages by potential purchasers.

3. A display rack comprising:

an elongated base having a first edge and a second edge and a front and a rear;

said rack having a storage space for storing a plurality of relatively thin sheet type product packages having a size substantially equal to or greater than three inches by five inches;

U-shaped bracket for mounting said rack to a supporting surface at an angle of between 30 and 60 degrees;

first and second mounting posts attached to said base;

means for connecting said first mounting post and said second mounting post to form a mounting bracket at an acute angle relative to said elongated base; and wherein a portion of a side member attached to one of said edges of said base extends beyond said rear of said base for attachment of said second mounting post.

4. A rack assembly for displaying products, said assembly comprising:

a supporting surface;

a plurality of display racks, each display rack detachably mounted on said supporting surface and each said display rack comprising a flat base, side members, upright restraining member, and rear bracket;

said display racks mounted to said supporting surface to extend forward at an acute angle relative to said supporting surface in the horizontal plane; and wherein said display racks are angled about a vertical axis to hold product packages therein at an acute angle relative to said supporting surface.

5. A rack assembly according to claim 4, wherein said racks comprise an open-frame construction for high visibility and easy access of contents therein.

6. A display rack assembly including a plurality of racks as defined in claim 3, spaced apart from one another and individually mounted on said supporting surface.

7. A rack assembly according to claim 4, wherein said storage space is less than three inches wide.

8. A rack assembly according to claim 4, wherein at least one side member slopes down from rear to front.

9. A rack assembly according to claim 4, wherein said side members comprise an open frame construction to provide high visibility of contents thereof.

10. A rack assembly according to claim 4, wherein a restraint is provided at said front of said base for preventing articles therein from slipping out forward.

11. A rack assembly according to claim 4, wherein a label tab is attached to said base proximal to the front of said rack.

12. A display rack assembly as defined in claim 4 wherein said rack assembly includes:

first and second mounting posts attached to said base; and means for connecting said first mounting post and said second mounting post to form a mounting bracket at an acute angle relative to said base.

13. A display rack according to claim 3, wherein an upper portion of said first mounting post and an upper portion of said second mounting post are angled for fitting into a peg board.

14. A display rack according to claim 3, wherein downward facing hooks are formed by an upper portion of said first mounting post and an upper portion of said second mounting post for hanging said display rack on a supporting structure.

15. A display rack according to claim 3, wherein said first mounting post is connected to said second mounting post to form a U-shaped bracket; and the lower portion of said U-shaped bracket extending away from said base to form an L-shaped angle at slightly less than ninety degrees for retaining the lower end of said bracket to a supporting surface.

16. A rack assembly according to claim 4, wherein top portions of said rear bracket of said display racks comprise angled posts for fitting into a pegboard.

17. A high visibility storage rack assembly as defined in claim 1, further comprising at least one plate extending parallel to and secured to one of said first and second side members.

* * * * *